US010749303B2

(12) United States Patent
Lu et al.

(10) Patent No.: US 10,749,303 B2
(45) Date of Patent: Aug. 18, 2020

(54) LAMP DEVICE WITH CHANGEABLE LAMP SOCKET

(71) Applicant: Xiamen PVTECH Co., Ltd., Xiamen, Fujian (CN)

(72) Inventors: Fuxing Lu, Fujian (CN); Xiaoping Lan, Fujian (CN)

(73) Assignee: Xiamen PVTECH Co., Ltd., Xiamen, Fujian (CN)

( * ) Notice: Subject to any disclaimer, the term of this patent is extended or adjusted under 35 U.S.C. 154(b) by 0 days.

(21) Appl. No.: 16/510,973

(22) Filed: Jul. 14, 2019

(65) Prior Publication Data

US 2020/0059053 A1 Feb. 20, 2020

(30) Foreign Application Priority Data

Aug. 17, 2018 (CN) ..... 2018 1 0937663

(51) Int. Cl.

| | |
|---|---|
| ***H01R 33/94*** | (2006.01) |
| ***F21V 17/06*** | (2006.01) |
| ***F21V 19/00*** | (2006.01) |
| ***H01R 33/08*** | (2006.01) |

(52) U.S. Cl.

CPC ..... *H01R 33/942* (2013.01); *F21V 17/06* (2013.01); *F21V 19/0005* (2013.01); *H01R 33/08* (2013.01)

(58) Field of Classification Search

CPC ... H01R 33/942; H01R 33/08; F21V 19/0005; F21V 17/06

See application file for complete search history.

(56) References Cited

U.S. PATENT DOCUMENTS

| | | | | |
|---|---|---|---|---|
| 2007/0242466 | A1* | 10/2007 | Wu | F21V 19/008 362/362 |
| 2010/0201239 | A1* | 8/2010 | Mostoller | F21S 8/031 313/1 |
| 2015/0003053 | A1* | 1/2015 | Ariyoshi | F21V 23/0471 362/223 |
| 2015/0364886 | A1* | 12/2015 | Jansen | F21K 9/272 362/221 |

* cited by examiner

*Primary Examiner* — Donald L Raleigh
(74) *Attorney, Agent, or Firm* — Winston Hsu

(57) ABSTRACT

A lamp device with changeable lamp socket includes a light tube, a light source plate received in the light tube, and two lamp sockets locked with two ends of the light tube. The lamp socket includes a first tubular body, a first covering plate, and two conductive plugs. The lamp device further includes two adapter covers detachably locked on the lamp sockets. Each adapter cover includes a second tubular body, a second covering plate, and a conductive component. For each of the lamp sockets and the corresponding adapter cover, the conductive plugs are inserted into insertion holes of the second covering plate, and the conductive component is electrically connected to the conductive plugs, passes through an opening of the second covering plate, and exposed from the second covering plate.

7 Claims, 4 Drawing Sheets

LAMP DEVICE WITH CHANGEABLE LAMP SOCKET

BACKGROUND OF THE INVENTION

1. Field of the Invention

The present invention relates to a lamp device, in particular to a lamp device with changeable lamp socket.

2. Description of the Prior Art

From past tungsten lamps, fluorescent lamps, halogen lamps to nowadays light-emitting diodes (LEDs) as well as electrodeless lamps, lamp devices are combined with designs, therefore even becoming decorations in lives, instead of being merely functional devices.

Existing lamp devices are provided with predetermined assembled parts. As a result, the user has to use the lamp device designed by the manufacturer and has fewer options. For instance, the user may want to assemble a certain light tube with the lamp holder in the user's house; however, the user fails to do this because the light tube cannot be adapted to the lamp holder. Therefore, it is an issue to design a lamp device with different assembling ways to satisfy users' requirements.

SUMMARY OF THE INVENTION

Hence, a lamp device capable of being assembled with different adapter covers to provide more options for the users is required.

In view of these, a lamp device with changeable lamp socket is provided. The lamp device comprises a light tube, a light source plate received in the light tube, and two lamp sockets respectively locked with two ends of the light tube. Each of the lamp sockets comprises a first tubular body, a first covering plate, and two conductive plugs. One ends of the two first tubular bodies are respectively fitted over two end portions of the light tube, and each of the first covering plates covers the other end of the corresponding first tubular body. For each of the lamp sockets, the two conductive plugs are electrically connected to the light source plate and protruding out of the corresponding first covering plate. The lamp device further comprises two adapter covers detachably locked on the lamp sockets, respectively. Each of the adapter covers comprises a second tubular body, a second covering plate, and a conductive component. One end of the second tubular body of each of the adapter covers is fitted over the corresponding lamp socket. For each of the adapter covers, the second covering plate covers the other end of the second tubular body. Each of the second covering plates comprises two protruding posts and an opening. For each of the second covering plates, the two protruding posts are protruding from an inner surface of the second covering plate, the opening is between the protruding posts of the second covering plate, and each of the protruding posts has an insertion hole. For each of the lamp sockets and the corresponding adapter cover, the conductive plugs are inserted into the insertion holes, and the conductive component is electrically connected to the conductive plugs, passes through the opening, and exposed from the second covering plate, so that the lamp device is capable of providing different adapter structures.

In some embodiments, the light tube comprises an upper body and a lower body connected with each other, and an outer surface of the lower body has a rib structure.

In some embodiments, the lamp device further comprises a lamp holder, and the adapter covers are configured on the lamp holder.

In some embodiments, each of the second covering plates comprises a protruding portion configured on an outer side thereof, and the opening is located in the protruding portion.

In some embodiments, for each of the second covering plates, the insertion holes are in communication with the protruding portion and are located at two sides of the opening.

In some embodiments, each of the conductive components comprises two conductive sheets.

In some embodiments, each of the conductive sheets comprises a main body and a bent portion connected to the main body, each of the main bodies is electrically connected to the corresponding conductive plug, and each of the bent portions is exposed from an outer surface of the corresponding second covering plate to cover the corresponding insertion hole.

In some embodiments, each of the protruding portions comprises a recessed groove for receiving the bent portions of the corresponding conductive sheets.

In some embodiments, each of the conductive components comprises an electrical connecting member, a conductive protruding member, and a conductive post; the electrical connecting member of each of the adapter covers is electrically connected to the conductive plugs of the corresponding lamp socket, and each of the conductive protruding members is received in the corresponding electrical connecting member; each of the conductive posts comprises a plug hole, each of the conductive protruding members is inserted into the plug hole of the corresponding conductive post, and each of the conductive posts passes through the opening of the corresponding second covering plate and protruding out of the corresponding second covering plate.

In some embodiments, each of the electrical connecting members is an arch structure comprising a connecting body having a hole and two legs connected to the connecting body; each of the conductive protruding members passes through the hole of the corresponding connecting body and protruding out of the corresponding connecting body; for each of the lamp sockets and the corresponding adapter cover, the legs are electrically connected to the conductive plugs, respectively.

Accordingly, the lamp device according to embodiments of the present invention can be assembled with different adapter covers to provide more options for the users. Therefore, the problems mentioned above can be solved properly.

These and other objectives of the present invention will no doubt become obvious to those of ordinary skill in the art after reading the following detailed description of the preferred embodiment that is illustrated in the various figures and drawings.

DETAILED DESCRIPTION

The detailed features and the advantages of the present invention will become more obvious from the following description for any person having ordinary skills in the art to carry out the claimed invention. Further, based on the disclosure, the claims, and the accompanying drawings, any person having ordinary skills in the art can understand the purpose and the advantages of the present invention easily.

Figure 1:
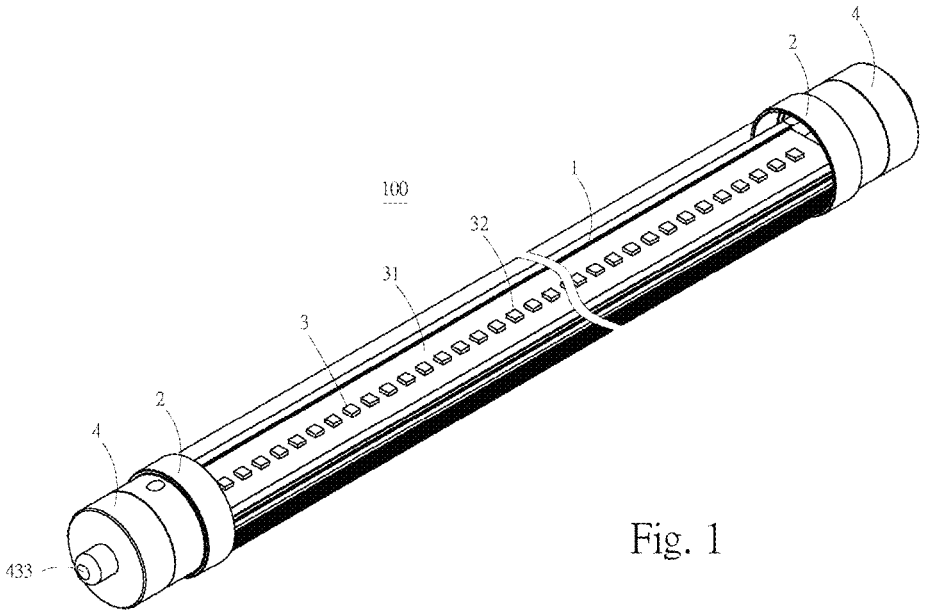
FIG. 1 illustrates an exploded view of a lamp device with changeable lamp socket according to a first embodiment of the present invention.
Figure 2:
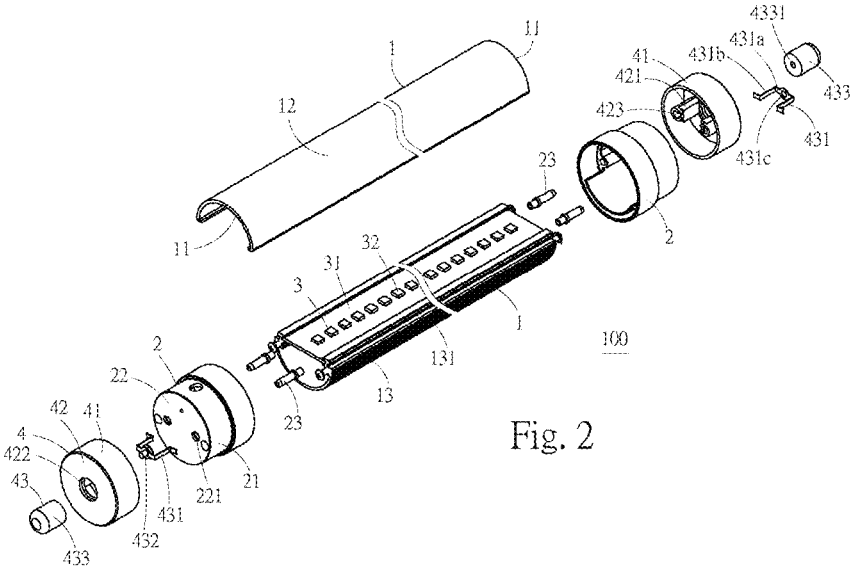
FIG. 2 illustrates an assembled view of the lamp device of the first embodiment.

Please refer to FIGS. 1 and 2, illustrating a light device with changeable lamp socket according to a first embodiment of the present invention. FIG. 1 illustrates an exploded view of the lamp device and FIG. 2 illustrates an assembled view of the lamp device, according to the first embodiment of the present invention.

In view of the aforementioned problems, in one embodiment, a lamp device 100 with changeable lamp sockets 2 is provided; namely, a lamp device 100 with adapter covers 4 is provided. The lamp device 100 comprises a light tube 1, a light source plate 3, two lamp sockets 2, and adapter covers 4.

In one embodiment, the light tube 1 is bar-shaped and comprises two opened ends 11. The light tube 1 comprises an upper body 12 and a lower body 13 connected with each other. The lower body 13 is an aluminum extrusion product capable of performing heat dissipation.

In one embodiment, the light source plate 3 is received in the light tube 1. The light source plate 3 comprises a substrate 31 and a plurality of light emitting components 32 arranged on the substrate 31.

In one embodiment, the two lamp sockets 2 are respectively locked with two ends of the light tube 1. Each of the lamp sockets 2 comprises a first tubular body 21, a first covering plate 22, and two conductive plugs 23. One ends of the two first tubular bodies 21 are respectively fitted over two end portions of the light tube 1. The first covering plate 22 covers the other end of the first tubular body 21. The two conductive plugs 23 are electrically connected to the light source plate 3, the two conductive plugs 23 respectively pass through two through holes 221 and protruding out of the first covering plate 22.

In one embodiment, two adapter covers 4 are detachably locked on the two lamp sockets 2. Each of the adapter covers 4 comprises a second tubular body 41, a second covering plate 42, and a conductive component 43.

In one embodiment, one end of the second tubular body 41 is fitted over the lamp socket 2, and the second covering plate 42 covers the other end of the second tubular body 41. The second covering plate 42 comprises two protruding posts 421 and an opening 422. The protruding posts 421 are protruding from an inner surface of the second covering plate 42. Each of the protruding posts 421 has an insertion hole 423, and the opening 422 is between the protruding posts 421 of the second covering plate 32. The conductive plugs 23 of the lamp socket 2 are inserted into the insertion holes 422 of the second covering plate 42, respectively. The conductive component 43 is electrically connected to the conductive plugs 23, passes through the opening 422, and exposed from the second covering plate 42.

In one embodiment, the conductive component 43 comprises an electrical connecting member 431, a conductive protruding member 432, and a conductive post 433. The electrical connecting member 431 of each of the adapter covers 4 is electrically connected to the conductive plugs 23 of the corresponding lamp socket 2. The conductive protruding member 432 is received in the electrical connecting member 431. The conductive post 433 comprises a plug hole 4331, and the conductive protruding member 432 is inserted into the plug hole 4331 of the conductive post 433. The conductive post 433 of each of the conductive components 43 passes through the opening 422 of the corresponding second covering plate 42 and protruding out of the corresponding second covering plate 42.

In one embodiment, each of the electrical connecting members 431 is an arch structure comprising a connecting body 431*a* and two legs 431*b* connected to the connecting body 431*a*. The connecting body 431*a* has a hole 431*c*. The conductive protruding member 432 passes through the hole 431*c* of the connecting body 431*a*. For each of the lamp sockets 2 and the corresponding adapter cover 4, the legs 431*b* of the electrical connecting member 431 are electrically connected to the conductive plugs 23, respectively.

In the first embodiment, the product model number for the lamp socket 2 is G13, and the product model number for the adapter cover 4 is FA8.

Figure 3:
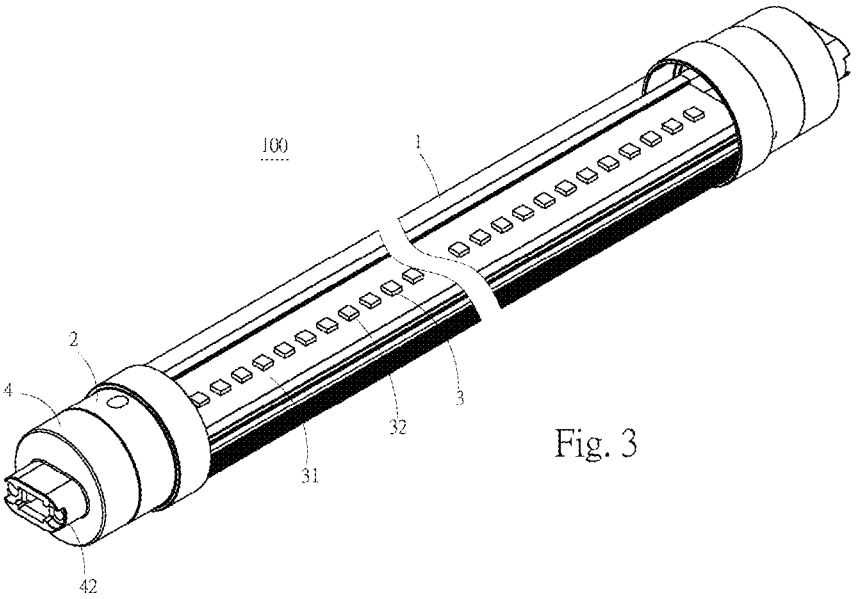
FIG. 3 illustrates an exploded view of a lamp device with changeable lamp socket according to a second embodiment of the present invention.
Figure 4:
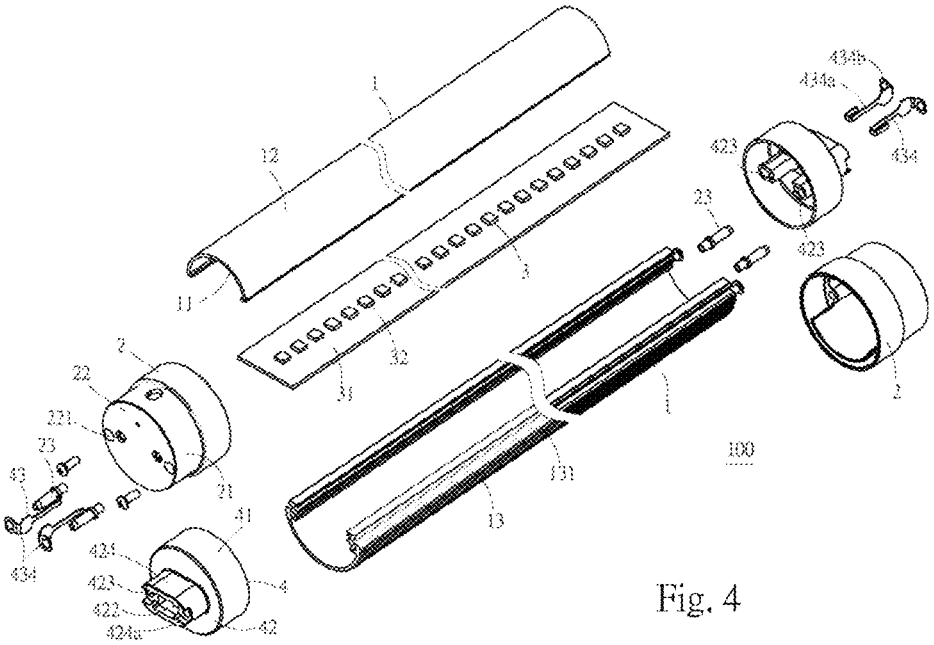
FIG. 4 illustrates an assembled view of the lamp device of the second embodiment.

Please refer to FIGS. 3 and 4, illustrating a light device with changeable lamp socket according to a second embodiment of the present invention. FIG. 3 illustrates an exploded view of the lamp device and FIG. 4 illustrates an assembled view of the lamp device, according to the second embodiment of the present invention.

The structure of the adapter cover 4 in the second embodiment is different from that in the first embodiment. In the second embodiment, the second covering plate 42 further comprises a protruding portion 424 configured on an outer side of the second covering plate 42, and the opening 422 is located in the protruding portion 424.

In one embodiment, for each of the second covering plates 42, the insertion holes 423 are in communication with the protruding portion 424 and are located at two sides of the opening 422.

In one embodiment, each of the conductive components 43 comprises two conductive sheets 434.

In one embodiment, each of the conductive sheets 434 comprises a main body 434*a* and a bent portion 434*b* connected to the main body 434*a*. Each of the main bodies 434*a* is electrically connected to the corresponding conductive plug 23, and each of the bent portions 434*b* is exposed from an outer surface of the corresponding second covering plate 42 to cover the corresponding insertion hole 423.

In one embodiment, each of the protruding portions 424 comprises a recessed groove 424*a* for receiving the bent portions 434*b* of the corresponding conductive sheets 434.

In the second embodiment, the product model number for the lamp socket 2 is G13, and the product model number for the adapter cover 4 is R17D.

In one embodiment, the light tube 1 comprises an upper body 12 and a lower body 13 connected with each other, and an outer surface of the lower body 13 has a rib structure 131.

In one embodiment, the lamp device 100 further comprises a lamp holder, and the adapter covers 4 are configured on the lamp holder.

Accordingly, the lamp device according to embodiments of the present invention can be assembled with different adapter covers to provide more options for the users. Therefore, the problems mentioned above can be solved properly.

Although particular embodiments of the invention have been described in detail for purposes of illustration, various modifications and enhancements may be made without departing from the spirit and scope of the invention. Accordingly, the invention is not to be limited except as by the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A lamp device with changeable lamp socket, comprising a light tube, a light source plate received in the light tube, and two lamp sockets respectively locked with two ends of the light tube, wherein each of the lamp sockets comprises a first tubular body, a first covering plate, and two conductive plugs; one ends of the two first tubular bodies are respectively fitted over two end portions of the light tube, and each of the first covering plates covers the other end of the corresponding first tubular body; for each of the lamp sockets, the two conductive plugs are electrically connected to the light source plate and protruding out of the corresponding first covering plate; the lamp device further comprises two adapter covers detachably locked on the lamp sockets, respectively; each of the adapter covers comprises a second tubular body, a second covering plate, and a conductive component; one end of the second tubular body of each of the adapter covers is fitted over the corresponding lamp socket; for each of the adapter covers, the second covering plate covers the other end of the second tubular body; each of the second covering plates comprises two protruding posts and an opening; for each of the second covering plates, the two protruding posts are protruding from an inner surface of the second covering plate, the opening is between the protruding posts of the second covering plate, and each of the protruding posts has an insertion hole; for each of the lamp sockets and the corresponding adapter cover, the conductive plugs are inserted into the insertion holes, and the conductive component is electrically connected to the conductive plugs, passes through the opening, and exposed from the second covering plate, so that the lamp device is capable of providing different adapter structures;

wherein each of the second covering plates comprises a protruding portion configured on an outer side thereof, and the opening is located in the protruding portion; and wherein for each of the second covering plates, the insertion holes are in communication with the protruding portion and are located at two sides of the opening.

2. The lamp device according to claim 1, wherein the light tube comprises an upper body and a lower body connected with each other, and an outer surface of the lower body has a rib structure.

3. The lamp device according to claim 1, wherein each of the conductive components comprises two conductive sheets.

4. The lamp device according to claim 3, wherein each of the conductive sheets comprises a main body and a bent portion connected to the main body, each of the main bodies is electrically connected to the corresponding conductive plug, and each of the bent portions is exposed from an outer surface of the corresponding second covering plate to cover the corresponding insertion hole.

5. The lamp device according to claim 4, wherein each of the protruding portions comprises a recessed groove for receiving the bent portions of the corresponding conductive sheets.

6. The lamp device according to claim 1, wherein each of the conductive components comprises an electrical connecting member, a conductive protruding member, and a conductive post; the electrical connecting member of each of the adapter covers is electrically connected to the conductive plugs of the corresponding lamp socket, and each of the conductive protruding members is received in the corresponding electrical connecting member; each of the conductive posts comprises a plug hole, each of the conductive protruding members is inserted into the plug hole of the corresponding conductive post, and each of the conductive posts passes through the opening of the corresponding second covering plate and protruding out of the corresponding second covering plate.

7. The lamp device according to claim 6, wherein each of the electrical connecting members is an arch structure comprising a connecting body having a hole and two legs connected to the connecting body; each of the conductive protruding members passes through the hole of the corresponding connecting body and protruding out of the corresponding connecting body; for each of the lamp sockets and the corresponding adapter cover, the legs are electrically connected to the conductive plugs, respectively.

* * * * *